US011835920B2

(12) United States Patent
Kano

(10) Patent No.: US 11,835,920 B2
(45) Date of Patent: Dec. 5, 2023

(54) TONER AND MANUFACTURING METHOD THEREOF AND DEVELOPER CONTAINING THE SAME

(71) Applicant: SHARP KABUSHIKI KAISHA, Sakai (JP)

(72) Inventor: Tadanori Kano, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 250 days.

(21) Appl. No.: 17/164,206

(22) Filed: Feb. 1, 2021

(65) Prior Publication Data

US 2021/0255560 A1 Aug. 19, 2021

(30) Foreign Application Priority Data

Feb. 13, 2020 (JP) ..... 2020-022445

(51) Int. Cl.
*G03G 9/097* (2006.01)
*G03G 9/08* (2006.01)

(52) U.S. Cl.
CPC ..... *G03G 9/09725* (2013.01); *G03G 9/0808* (2013.01); *G03G 9/0812* (2013.01); *G03G 9/0819* (2013.01)

(58) Field of Classification Search
CPC ..... G03G 9/09708; G03G 9/09725
See application file for complete search history.

(56) References Cited

U.S. PATENT DOCUMENTS

2018/0067415 A1 3/2018 Sugahara

FOREIGN PATENT DOCUMENTS

| | | | | |
|---|---|---|---|---|
| JP | 2006267734 A | | 10/2006 | |
| JP | 4648212 | * | 3/2011 | ..... G03G 9/08 |
| JP | 2017-3659 | * | 1/2017 | ..... G03G 9/08 |
| WO | 2016/148012 A1 | | 9/2016 | |

OTHER PUBLICATIONS

Translation of JP 4648212.*
Translation of JP 2017-3659.*

* cited by examiner

*Primary Examiner* — Peter L Vajda
(74) *Attorney, Agent, or Firm* — ScienBiziP, P.C.

(57) ABSTRACT

Provided is a toner characterized by including at least a negatively-charged toner master particle, and an external additive externally added onto the surface of the toner master particle, wherein the external additive includes a fine powder and a small particle size silica having an average first particle diameter smaller than that of the fine powder, and wherein the fine powder is a composition containing at least aluminum hydroxide and silica and has a surface treated with silane.

4 Claims, 3 Drawing Sheets

TONER AND MANUFACTURING METHOD THEREOF AND DEVELOPER CONTAINING THE SAME

BACKGROUND OF THE INVENTION

Field of the Invention

The present invention relates to a toner and a manufacturing method thereof and a developer containing the same. More specifically, the present invention relates to a negatively-charged toner having high environmental charge performance for a long term through Deve Life (the product life of a developer), and a manufacturing method thereof and a developer containing the same.

Description of the Background Art

Recently, image formation devices using electrography, such as copiers, printers, and facsimile devices, have been widely spread with remarkable development of office automation equipment.

An image formation device using electrography commonly forms an image through a charging step that uniformly charges by a charging device the surface of an electrographic photoreceptor (also referred to as "photoreceptor") driving with rotation; an exposing step that projects laser light onto the surface of the charged photoreceptor by an exposure device and thus forms an electrostatic latent image; a developing step that develops the electrostatic latent image on the surface of the photoreceptor using an electrographic toner (also referred to as "toner") by a development device and thus forms a toner image; a transferring step that transfers the toner image on the surface of the photoreceptor onto a recording paper (also referred to as "recording medium" or "transfer medium") by a transfer device; and a fixing step that fixes the toner image onto the recording paper with heat by a fixing device.

Then, the remaining post-transfer toner, which remains on the surface of the photoreceptor after the image formation operation, is removed by a cleaning device in a cleaning step and recovered in a preset recovery part (developing chamber), and the remaining charge on the surface of the photoreceptor after the cleaning is statically eliminated by a static eliminating device in a static eliminating step so as to prepare for the next image formation.

Accordingly, a toner used for an image formation device requires various functions not only in a developing step, but also in each step of a transferring step, a fixing step, and a cleaning step.

For example, given that a small change of charge amount of a developer caused by difference in humidity is defined as high environmental charge performance, one way to improve environmental charge performance has been to use titanium oxide universally as an external additive for toner master particles. A developer containing a toner externally added with titanium oxide and a carrier can improve environmental charge performance and derive a good developing condition, but has a problem in that the environmental charge performance decreases with increasing cumulative total number of typed (referred to as "printed") pages by a copier. This is considered to arise from a process of stirring and frictionally charging a developer under pressure in a developing chamber, and to result from decrease in environmental charge performance occurring from embedment of an external additive into a toner particle or contamination in a carrier with an external additive. Especially, carrier contamination with titanium oxide has a profound effect, and environmental charge performance of a developer significantly decreases around the end of product life, and may sometimes be deteriorated to a degree comparable to that of a developer not externally added with titanium oxide.

Several technologies have been proposed for improving such problems in developers.

For example, for positively-charged toners, WO2016/148012 has proposed a toner including a plurality of toner particles that has a positively-charged toner master particle and a plurality of external additive particles each adhering onto the surface of the toner master particle, wherein the external additive particle has a silica particle, a metal hydroxide layer forming on the surface, and at least a part of a coat layer forming on the surface of the metal hydroxide layer, and wherein the coat layer is substantially composed of nitrogen-containing resin.

WO2016/148012 discloses a positively-charged toner that has toner master particles, and an external additive of silica particles coated with a metal hydroxide layer and a coat layer composed of nitrogen-containing resin, but does not disclose a negatively-charged toner, which is electrically exactly opposite, particularly a negatively-charged toner that contains negatively-charged toner master particles and an external additive.

As such, the present invention has an object to provide a negatively-charged toner having high environmental charge performance for a long term throughout Deve Life, and a manufacturing method thereof, and a developer containing the same.

SUMMARY OF THE INVENTION

The inventor earnestly made investigation to solve the problems described above; and consequently found that a negatively-charged toner having high environmental charge performance for a long term throughout Deve Life and a developer containing the same can be obtained by externally adding, as external additive, a fine powder that is a composition containing at least aluminum hydroxide and silica and has a surface treated with silane, and a small particle size silica that has an average first particle diameter smaller than that of the fine powder, to a negatively-charged toner; and reached completion of the present invention.

Accordingly, the present invention provides a toner characterized by including at least a negatively-charged toner master particle, and an external additive externally added onto the surface of the toner master particle, wherein the external additive includes a fine powder and a small particle size silica having an average first particle diameter smaller than that of the fine powder, and wherein the fine powder is a composition containing at least aluminum hydroxide and silica and has a surface treated with silane.

Moreover, the present invention provides a developer characterized by including the toner described above and a carrier.

Furthermore, the present invention provides a manufacturing method for the toner described above, the method being characterized by including:

- a first external addition that adds and mixes the external additive of the small particle size silica or the external additive of the small particle size silica and the large particle size silica, with the toner master particle, to externally add the external additive to the toner master particle, and
- a second external addition that further adds and mixes the external additive of the fine powder with the toner master particle thus obtained, to externally add the external additive to the toner master particle.

The present invention can provide a negatively-charged toner having high environmental charge performance for a long term throughout Deve Life, and a manufacturing method thereof, and a developer containing the same.

Environmental charge performance can be represented by the following formula:

Environmental charge performance $A$-value=(charge amount at low humidity,$L$-value)/(charge amount at high humidity,$H$-value)

and an ideal value is 1, wherein the value closer to the ideal value means higher environmental charge performance.

A toner of the present invention exerts more the effects described above, when satisfies at least any one of the following conditions (1)-(4):

(1) the toner master particle is further externally added with a large particle size silica having an average first particle diameter larger than that of the fine powder;

(2) when an electrostatic capacity value a of the toner master particle is less than 1, a coating ratio of the small particle size silica, the fine powder, and the large particle size silica on the toner master particle, 1:P:Q, satisfies relations of the following formulae:

$P \geq 0.20$ and $0.27 \geq Q \geq 0.04$, and when an electrostatic capacity value a of the toner master particle is 1 or more, a coating ratio of the small particle size silica, the fine powder, and the large particle size silica on the toner master particle, 1:X:Y, satisfies relations of the following formulae:

$X \geq 0.46$ and $0.27 \geq Y \geq 0.04$;

(3) the fine powder has a dispersion value f of 0.94 or more on the toner master particle; and (4) the fine powder has an average first particle diameter of 10 to 40 nm.

A manufacturing method of the toner of the present invention can manufacture efficiently the toner of the present invention, when satisfies at least the following condition (5):

(5) the treatment time for the second external addition is 1.1-fold or more of the treatment time of the first external addition.

Figure 1A:
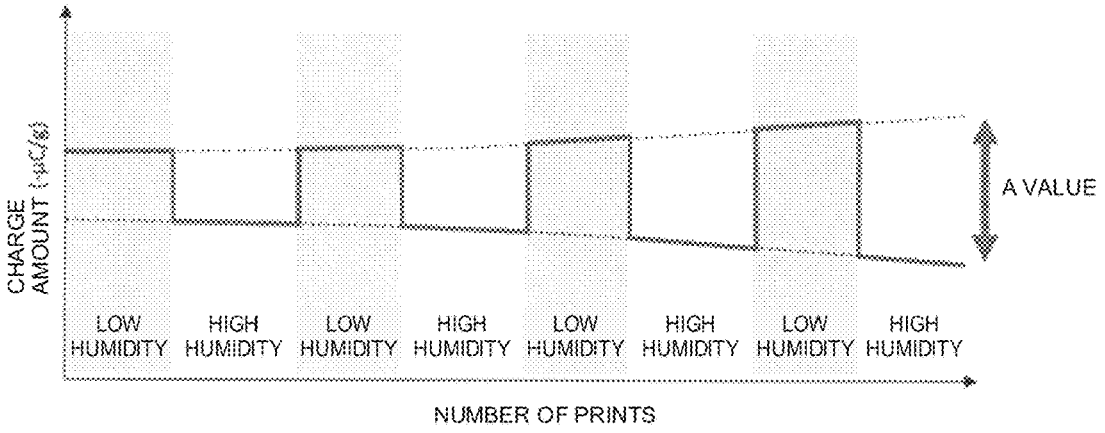
FIGS. 1A, 1B, and 1C show relations between the number of printed pages and charge amount for a toner.

DESCRIPTION OF THE PREFERRED EMBODIMENTS (1) Toner

The toner of the present invention is characterized by including at least negatively-charged toner master particle, and an external additive externally added onto the surface of the toner master particle, wherein the external additive includes a fine powder and a small particle size silica having an average first particle diameter smaller than that of the fine powder, and wherein the fine powder is a composition containing at least aluminum hydroxide and silica and has a surface treated with silane.

In other words, the toner of the present invention is characterized in that a negatively-charged toner master particle is externally added with an external additive having a specific physical property.

Hereinafter, a description will now be made for the external additive, which is a characteristic component of the toner of the present invention, and descriptions will be made for the toner master particle, which is a base of the toner, and a manufacturing method for the toner, and a developer containing the toner.

(1-1) External Additive

The external additive generally has functions for improving transfer and charge of a toner, as well as stirring efficiency with a carrier in use of a two-component developer as a toner, and the like.

The toner of the present invention includes, as external additives, a fine powder and a small particle size silica, or preferably includes a fine powder and a small particle size silica, and further, a large particle size silica.

(1-1-1) Fine Powder

The fine powder used in the present invention is a composition containing aluminum hydroxide and silica, and has a surface treated with silane.

A main component of the composition included in the fine powder is silica, and the content of aluminum hydroxide is around 5-15% by mass, approximately around 10% by mass.

A fine silica powder as used in the examples can be employed, as long as it is a fine powder that satisfies a requirement of the present invention.

The fine powder preferably has a dispersion value f of 0.94 or more on the toner master particle.

Dispersion value f numerically indicates dispersion condition of the fine powder on the toner master particle, and can be derived by the following formula:

Dispersion value $f$=(resistance component value of externally-added toner including only a fine powder)/(resistance component value of non-externally-added toner).

A particular measuring method will be described in the examples.

With a dispersion value f of the fine powder of less than 0.94, environmental charge performance A-value may increase. And yet, the upper limit is about 0.99.

The fine powder preferably has an average first particle diameter of 10 to 40 nm.

With an average first particle diameter of the fine powder of less than 10 nm, first particles may aggregate on the surface of the toner, leading to a smaller dispersion value of the fine powder. By contrast, with an average first particle diameter of the fine powder of more than 40 nm, a coating rate to per hundred resin may be reduced, leading to increase in environmental charge performance A-value. A preferable average first particle diameter of the fine powder is 12-25 nm, more preferably 13-20 nm.

(1-1-2) Small Particle Size Silica

The small particle size silica used in the present invention has an average first particle diameter smaller than that of a fine powder.

The average first particle diameter of the small particle size silica only need to satisfy the conditions described above, and is about 7 to 40 nm, preferably about 7-30 nm, more preferably about 7-12 nm.

As the small particle size silica, a silica particle hydrophobized by a surface treatment commonly used in the art with hexamethyldisilazane (HMDS), dimethyl-dicyclosilane (DDS), octylsilane (OTAS), polydimethylsiloxane (PDMS), and the like can be used, preceded by being subjected to such treatment if not hydrophobized.

Origin of the small particle size silica is not particularly limited, and for example, a silica particle can be used which is obtained by hydrophobizing silica derived by flame hydrolysis, which burns silicon tetrachloride in oxyhydrogen flame, a sol-gel method, or the like.

(1-1-3) Large Particle Size Silica

The large particle size silica used in the present invention has an average first particle diameter larger than that of the fine powder.

The average first particle diameter of the large particle size silica only need to satisfy the conditions described above, and is about 50-300 nm, preferably about 65-200 nm, more preferably about 80-120 nm.

Similar to the small particle size silica, as the large particle size silica, a silica particle hydrophobized by a surface treatment commonly used in the art with hexamethyldisilazane (HMDS), dimethyl-dicyclosilane (DDS), octylsilane (OTAS), polydimethylsiloxane (PDMS), and the like can be used, preceded by being subjected to such treatment if unhydrophobized, as is the case with the small particle size silica.

Origin of the large particle size silica is not particularly limited, and for example, a silica particle can be used which is obtained by hydrophobizing silica derived by flame hydrolysis, which burns silicon tetrachloride in oxyhydrogen flame, a sol-gel method, or the like.

(1-1-4) Coating Ratio of External Additive

In the toner of the present invention, it is preferable that when an electrostatic capacity value a of the toner master particle is less than 1, a coating ratio of the small particle size silica, the fine powder, and the large particle size silica on the toner master particle, 1:P:Q, satisfy relations of the following formulae:

$$P \geq 0.20 \text{ and } 0.27 \geq Q \geq 0.04 \quad \text{(Relation A); and}$$

that when an electrostatic capacity value a of the toner master particle is 1 or more, a coating ratio of the small particle size silica, the fine powder, and the large particle size silica on the toner master particle, 1:X:Y, satisfy relations of the following formulae:

$$X \geq 0.46 \text{ and } 0.27 \geq Y \geq 0.04 \quad \text{(Relation B).}$$

The electrostatic capacity value a of the toner master particle is a measured value of an electrostatic capacity component of a compressed powder mass (solid sample) of the toner master particle, and a particular measuring method thereof will be described in the examples.

The electrostatic capacity value a of the toner master particle used in the present invention is about 0.900-1.100.

The coating ratio of the external additives can be derived as a ratio of coating rates of individual external additives by performing model calculation in a projected area using the average particle diameter and specific gravity of the toner master particle, and the average particle diameter and specific gravity of each of the external additives, and a particular measuring method thereof will be described in the examples. Moreover, the coating ratio can be confirmed from a scanning electron microscopy (SEM) image of the externally-added toner.

Relation A

When an electrostatic capacity value a of the toner master particle is less than 1, environmental charge performance A-value may increase at a coating ratio P of the fine powder of less than 0.20. Preferred is P≥0.29. As yet, the upper limit is about 0.8.

When an electrostatic capacity value a of the toner master particle is less than 1, environmental charge performance A-value may increase at a coating ratio Q of the large particle size silica of less than 0.04 or more than 0.27. Preferred is 0.12≥Q≥0.06.

Relation B

When an electrostatic capacity value a of the toner master particle is 1 or more, environmental charge performance A-value may increase at a coating ratio X of the fine powder of less than 0.46. Preferred is X≥0.58. And yet, the upper limit is about 0.8.

When an electrostatic capacity value a of the toner master particle is 1 or more, environmental charge performance A-value may increase at a coating ratio Y of the large particle size silica of less than 0.04 or more than 0.27. Preferred is 0.12≥Y≥0.06.

The formulation amount of the external additives is not particularly limited as long as it satisfies the requirements of the coating ratio described above, but the total amount of the external additives is about 1.0-5.0 parts by mass, more preferably 2.0-4.0 parts by mass, to 100 parts by mass of the toner master particle.

When the external additives include a small particle size silica and a fine powder, their ratio is about 1:0.1-1.0 by mass ratio.

Moreover, the external additives include a small particle size silica, a fine powder, and a large particle size silica, their ratio is about 1:0.1-1.0:0.4-2.5 by mass ratio.

(1-2) Negatively-Charged Toner Master Particle

The negatively-charged toner master particle contained in the toner of the present invention includes at least a binder resin, a colorant, a mold lubricant, and a charge regulator, and may include a known additive in the range without inhibiting an effect of the present invention, if required.

(1-2-1) Binder Resin

As the binder resin contained in the toner of the present invention, polyester-based resin can be preferably used.

Polyester-based resin can be commonly derived by condensation polymerization reaction, esterification, or transesterification reaction of one or more selected from bivalent alcohol components and trivalent or more polyhydric alcohol components with one or more selected from bivalent carboxylic acids and trivalent or more polycarboxylic acids, by a known method.

The condition in the condensation polymerization reaction only needs to be set appropriately depending on reactivity of a monomer component, and furthermore, the reaction only need to be terminated at the time that a polymer has a preferred physical property. Examples include a reaction temperature of about 170-250° C. and a reaction pressure of about 5 mmHg to normal pressure.

Examples of the bivalent alcohol components include alkyleneoxide adducts of bisphenol A such as polyoxypropylene(2.2)-2,2-bis(4-hydroxyphenyl)propane, polyoxypropylene(3.3)-2,2-bis(4-hydroxyphenyl)propane, polyoxypropylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; diols such as ethylene glycol, diethylene glycol, triethylene glycol, 1,2-propyleneglycol, 1,3-propyleneglycol, 1,4-butanediol, neopentylglycol, 1,4-butenediol, 1,5-pentanediol, 1,6-hexanediol, 1,4-cyclohexanedimethanol, dipropyleneglycol, polyethylene glycol, polypropylene glycol, and polytetramethylene glycol; bisphenol A; propylene adducts of bisphenol A; ethylene adducts of bisphenol A; and hydrogenated bisphenol A.

Examples of the trivalent or more polyhydric alcohol components include sorbitol, 1,2,3,6-hexanetetrol, 1,4-sorbitan, pentaerythritol, dipentaerythritol, tripentaerythritol, sucrose (saccharose), 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The toner of the present invention can employ a single one or a combination of two or more of the bivalent alcohol components and trivalent or more polyhydric alcohol components described above.

Examples of the bivalent carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenylsuccinic acid, n-dodecylsuccinic acid, n-octylsuccinic acid, isooctenylsuccinic acid, isooctylsuccinic acid, and acid anhydrides or lower alkyl esters thereof.

Examples of the trivalent or more polycarboxylic acid include 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic-2-methyl-2-methylenecarboxypropane, 1,2,4-cyclohexanetricarboxylic acid, tetra(methylenecarboxylic)methane, 1,2,7,8-octanetetracarboxylic acid, pyromellitic acid, Empol trimer acid, and acid anhydrides or lower alkyl esters thereof.

The toner of the present invention can employ a single one or a combination of two or more of the bivalent carboxylic acids and trivalent or more polycarboxylic acids described above.

In the toner of the present invention, the binder resin preferably has a mass-average molecular weight in the range of 9,000-90,000, in which a proportion of molecular weight of 100,000 or more in the molecular weight distribution is 10-30%. When the binder resin has a mass-average molecular weight and a proportion of molecular weight of 100,000 or more that fall within the range described above, more compatible effect of low-temperature fixability and hot offset resistance is further exerted in a belt fixing device.

When the binder resin has a mass-average molecular weight of less than 9,000, releasability in a high temperature fixing part is likely to decrease. By contrast, when the binder resin has a mass-average molecular weight of more than 90,000, low-temperature fixability is likely to decrease.

Setting a mass-average molecular weight of the binder resin to 20,000 or more provides better releasability in a high temperature fixing part more securely, whereas setting a mass-average molecular weight of the binder resin of 70,000 or less provides better low-temperature fixability more securely.

Accordingly, a more preferable range of the mass-average molecular weight of the binder resin is 20,000-70,000.

Additionally, when the binder resin has a proportion of the molecular weight of 100,000 or more in the molecular weight distribution of less than 10%, releasability in a high temperature fixing part is likely to decrease. By contrast, when the binder resin has a proportion of the molecular weight of 100,000 or more in the molecular weight distribution of more than 30%, low-temperature fixability is likely to decrease. Setting the proportion to 20% or less provides better low-temperature fixability more securely.

Accordingly, a more preferable range of the proportion of molecular weight of 100,000 or more in the molecular weight distribution of the binder resin is 10-20%.

The formulation amount of the binder resin in the toner master particle is preferably 60-90% by mass, and particularly preferably 70-85% by mass.

(1-2-2) Colorant

As the colorant contained in the toner of the present invention, various kinds and colors of organic and inorganic pigments and dyes commonly used in the art can be employed, and examples include black, white, yellow, orange, red, purple, blue, and green colorants.

Examples of the black colorants include carbon black, copper oxide, manganese dioxide, aniline black, activated carbon, non-magnetic ferrite, magnetic ferrite, and magnetite.

Examples of the white colorants include zinc flower, titanium oxide, and antimony white, and zinc sulfide.

Examples of the yellow colorants include chrome yellow, zinc yellow, cadmium yellow, yellow iron oxide, mineral fast yellow, nickel titanium yellow, Navel Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, and C.I. Pigment Yellow 138.

Examples of the orange colorants include red chrome yellow, molybdenum orange, Permanent Orange GTR, Pyrazolone Orange, Vulcan Orange, Indanthrene Brilliant Orange RK, Benzidine Orange G, Indanthrene Brilliant Orange GK, C.I. Pigment Orange 31, and C.I. Pigment Orange 43.

Examples of the red colorants include red oxide, cadmium red, red lead, mercury sulfide, cadmium, Permanent Red 4R, Lithol Red, Pyrazolone Red, Watching Red, calcium salt, Lake Red C, Lake Red D, Brilliant Carmine 6B, Eosine Lake, Rhodamine Lake B, Alizarin Lake, Brilliant Carmine 3B, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of the purple colorants include manganese purple, Fast Violet B, and Methyl Violet Lake.

Examples of the blue colorants include iron blue, cobalt blue, Alkaline Blue Lake, Victoria Blue Lake, Phthalocyanine Blue, metal-free Phthalocyanine Blue, Phthalocyanine Blue partial chloride, Fast Sky Blue, Indanthrene Blue BC, C.I. Pigment Blue 15, C.I. Pigment Blue 15:2, C.I. Pigment Blue 15:3, C.I. Pigment Blue 16, and C.I. Pigment Blue 60.

Examples of the green colorants include chrome green, chromium oxide, Pigment Green B, Mica Light Green Lake, Final Yellow Green G, and C.I. Pigment Green 7.

The toner of the present invention can employ a single one or a combination of two of the colorants described above, and the combination thereof may include different colors or the same color.

In addition, two or more colorants may be formed into composite particles and be used. The composite particles can be manufactured by, for example, adding an appropriate amount of water, lower alcohol, and the like to two or more colorants, granulating by a common granulator such as a high-speed mill, and drying. Furthermore, this may be formed into masterbatch and be used so as to uniformly disperse the colorants into the binder resin. The composite particles and the masterbatch are admixed into a toner composition in dry mixing.

The content of the colorant in the toner of the present invention is not particularly limited, but is preferably 0.1-20 parts by mass, more preferably 0.2-10 parts by mass, to 100 parts by mass of the binder resin.

As long as the content of the colorant falls within the range described above, it is possible to have high image density and to form an image with particularly good picture quality, without impairing various physical properties of the toner.

If calculated, the content of the colorant in the toner is preferably 2.5-7.5% by mass, more preferably 3.0-6.5% by mass.

(1-2-3) Mold Lubricant

As the mold lubricant contained in the toner of the present invention, a mold lubricant commonly used in the art can be employed.

Examples include petroleum waxes such as paraffin wax and microcrystalline wax and derivatives thereof; hydrocarbon-based synthetic waxes such as Fischer-Tropsch wax, polyolefin wax (such as polyethylene wax and polypropylene wax), low-molecular-weight polypropylene wax, and polyolefin-based polymer wax (such as low-molecular-weight polyethylene wax), and derivatives thereof; plant-based waxes such as carnauba wax, rice wax, and candelilla wax, and derivatives thereof, and Japan wax; animal-based waxes such as beeswax and spermaceti wax; oil- and fat-based synthetic waxes such as fatty acid amide and phenolic fatty acid ester; long-chain carboxylic acids and derivatives thereof; long-chain alcohols and derivatives thereof; silicone-based polymers; and higher fatty acids; and among them, hydrocarbon-based wax is preferable.

The derivatives described above include oxides, a block copolymer of vinyl-based monomer and wax, and a graft-modified material of vinyl-based monomer and wax.

The present invention can employ a single one or a combination of two or more of the mold lubricants described above.

The mold lubricant preferably has a melting point of 70° C. or less in view of a compatible effect of low-temperature fixability and hot offset resistance, particularly low-temperature fixability, of the toner in a belt fixing device. The lower limit of the melting point is about 60° C.

The content of the mold lubricant in the toner of the present invention is not particularly limited, but is preferably 0.2-20 parts by mass, more preferably 0.5-10 parts by mass, and particularly preferably 1.0-8.0 parts by mass, to 100 parts by mass of the binder resin.

As long as the content of the mold lubricant falls within the range described above, it is possible to have high image density and to form an image with particularly good picture quality, without impairing various physical properties of the toner.

If calculated, the content of the mold lubricant in the toner is preferably 2.0-7.0% by mass, more preferably 3.0-5.0% by mass.

(1-2-4) Charge Regulator

As the charge regulator contained in the toner of the present invention, an electric charge regulator for regulating negative charge, commonly used in the art, can be employed.

Examples of the electric charge regulators for regulating negative charge include oil-soluble dyes such as Oil Black and Spiron Black, metal-containing azo compounds, azo complex dyes, metal salts of naphthenic acid, metal complexes and metal salts of salicylic acid and derivatives thereof (with chromium, zinc, zirconium, or the like as the metal), boron compounds, fatty acid soaps, long-chain alkyl carboxylic acid salts, and resin acid soaps.

The toner of the present invention can employ a single one or a combination of two or more of the electric charge regulators described above.

The content of the charge regulator in the toner of the present invention is not particularly limited, but is preferably 0.5-3 parts by mass, more preferably 1-2 parts by mass, to 100 parts by mass of the binder resin.

As long as the content of the charge regulator falls within the range described above, it is possible to have high image density and to form an image with particularly good picture quality, without impairing various physical properties of the toner.

If calculated, the content of the charge regulator in the toner is preferably 0.5-2.0% by mass, more preferably 0.7-1.5% by mass.

(1-2-5) Physical Property of Toner

Average First Particle Diameter of Toner

The toner of the present invention preferably has an average first particle diameter of 4-10 μm.

With an average first particle diameter of less than 4 μm, a toner master body particle has a too small particle diameter, possibly causing high charge and less flowability. Once such high charge and less flowability generate, the toner can be no longer supplied stably to a photoreceptor, possibly generating ground fog and reduced image density, and the like. By contrast, with an average first particle diameter of more than 10 μm, it is not preferable because the toner master body particle has a large particle diameter, which increases bed height of an image thus formed and makes the image have remarkable granularity, thus failing to provide a highly-definition image. Additionally, the larger particle diameter of the toner master body particle reduces a specific surface area, leading to less charge amount of the toner. With the less charge amount of the toner, the toner is no longer supplied stably to a photoreceptor, possibly generating pollution within a device due to toner scattering. Preferable average first particle diameter is 5-8 μm.

A measuring method for average first particle diameter will be describe in detail in the examples.

(2) Manufacturing Method for Toner

A manufacturing method for the toner of the present invention is characterized by including; a first external addition that adds and mixes the external additive of the small particle size silica or the external additive of the small particle size silica and the large particle size silica, with the toner master particle, to externally add the external additive to the toner master particle, and a second external addition that further adds and mixes the external additive of the fine powder with the toner master particle thus obtained, to externally add the external additive to the toner master particle.

(2-1) First External Addition

At the first external addition, the external additive of the small particle size silica is added and mixed with the toner master particle, or the external additive of the small particle size silica and the large particle size silica is added and mixed with the toner master particle.

The operations for the addition and mixing can be performed with a known device commonly used in the art, and the conditions only need to be set appropriately corresponding to a target material and a desired physical property.

(2-2) Second External Addition

At the second external addition, the external additive of the fine powder is further added and mixed with the toner master particle thus obtained.

As is the case with the first external addition, operations for the addition and mixing can be performed with a known device commonly used in the art, and the conditions only need to be set appropriately corresponding to a target material and a desired physical property.

(2-3) Conditions of First and Second External Addition

The treatment time for the second external addition is preferably 1.1-fold or more of the treatment time for the first external addition. Here, the treatment time means a stirring time.

When the treatment time for the second external addition is less than 1.1-fold of that of the first external addition, the environmental charge performance A-value may increase. In the addition, the upper limit is about five-fold.

For example, when the first external addition has a treatment time of 0.5-1 minutes, the second external addition has about 0.6-1.1 minutes.

(2-4) Manufacturing Method for Toner Master Particle

The toner master particle used in the present invention can be manufactured with a known device commonly used in the art by known methods, for example, a mixing step that mixes a roughly-milled, melt-kneaded material containing at least a binder resin, a colorant and a mold lubricant, with a filler; a finely-milling step that finely mills the mixture obtained in the mixing step, a classifying step that classifies the finely-milled material obtained in the finely-milling step, and a spheroidizing treatment step that spheroidizes the classified material obtained in the classifying step, with a hot blast.

Dry methods are preferable in view of smaller number of steps and less cost of facilities as compared to wet methods, and among them, grinding methods are particularly preferable.

The condition of each of the following steps only need to set appropriately corresponding to a target material and a desired physical property.

(3) Developer (Two-Component Developer)

The developer of the present invention includes the toner of the present invention and a carrier.

Carrier

The toner of the present invention can be used in either form of a single-component developer or a two-component developer; in use as a two-component developer, a carrier is further blended in addition to the external additive.

As the carrier, a carrier commonly used in the art can be employed, and examples include one in which mono- or composite ferrite and a carrier core particle containing iron, copper, zinc, nickel, cobalt, manganese, chromium, or the like are surface-coated with a known coating material.

The average particle diameter of the carrier is preferably 10-100 μm, more preferably 20-50 μm.

The formulation amount of the carrier is not particularly limited, but is preferably 4-15 parts by mass, more preferably 5-10 parts by mass, to 100 parts by mass of the toner master particle.

EXAMPLES

Hereinafter, the present invention will be specifically described with reference to the manufacturing examples, examples, and comparative examples, but the present invention is not limited to the examples described below, as long as it does not exceed the spirit thereof.

In the manufacturing examples, examples, and comparative examples, each physical property value is measured by the methods as follows.

Average First Particle Diameter of Each External Additive (nm)

The average first particle diameter of each of the external additives is derived by imaging the particles with a scanning electron microscope (SEM) (manufactured by Hitachi High-Tech Corporation; model: S-4800), measuring arbitrarily particle sizes (major axis) of 100 particles of the external additive from the image thus obtained, calculating their average value, and defining it as an average first particle diameter.

Average First Particle Diameter of Toner Master Particle (μm)

To 50 mL of electrolyte solution (manufactured by Beckman Coulter, Inc.; product name: ISOTON-II), 20 mg of the sample and 1 mL of sodium alkylether sulfate are added, and subjected to dispersion treatment for 3 minutes at a frequency of 20 kHz with an ultrasonic disperser (manufactured by AS ONE Corporation, a desk double-frequency ultrasonic washer; model: VS-D100) to produce a sample for measurement. The sample for measurement thus obtained is measured with a grain size distribution measuring device (manufactured by Beckman Coulter, Inc.; model: Multisizer 3) under conditions with an aperture diameter of 100 μm and a number of measured particles of 50000 counts, and an average first particle diameter (μm) is derived from a volumetric grain size distribution of the sample particles.

Coating Rate of External Additive

Model calculation is performed in a projected area using the average particle diameter and specific gravity of the toner master particle, and the average particle diameter and specific gravity of each external additive, to derive a ratio of coating rates of the external additives.

The externally-added toner is imaged with a scanning electron microscope (SEM) to confirm the ratio of the coating rates.

Electrostatic Capacity Value, a-Value

One g of the toner master particle is weighed out, enclosed into a stainless container with an inner diameter of 25 mm, and compressed at a pressure of 20 MPa for 20 seconds, to produce a solid sample with an inner diameter of 25 mm and a thickness of 2 mm.

An electrostatic capacity component of the solid sample is measured using a high-accuracy capacitance bridge (manufactured by Andeen Hagerling, Inc.; model: 2550A), and defined as an electrostatic capacity value a.

Dispersion Value of Fine Powder, f-Value

One g of the toner master particle is weighed out, enclosed into a stainless container with an inner diameter of 25 mm, and compressed at a pressure of 20 MPa for 20 seconds, to produce a solid sample with an inner diameter of 25 mm and a thickness of 2 mm.

A resistance component of the solid sample is measured using a high-accuracy capacitance bridge (manufactured by Andeen Hagerling, Inc. model: 2550), and defined as R1.

In the same manner, a solid sample of the toner is obtained in which only a fine powder is externally added to the toner master particle, and the resistance component thereof is measured and defined as R2.

A f-value is derived from the following formula:

$$f\text{-value}=R2/R1.$$

Charge Amount of Developer

A developer on a magroller in a developing chamber is sampled by 0.2 g, and charge amount is measured with a compact suction charge amount measuring device (manufactured by Trek Inc.; model: MODEL 210HS-2A).

Environmental Charge Performance A-Value

A color multifunction printer (manufactured by Sharp Corporation; model: MX-3631) was used as a machine for evaluation. The machine for evaluation was operated in an environmental testing room under three types of environments, 25° C. and 50% RH, 25° C. and 5% RH (low humidity), and 25° C. and 80% RH (high humidity) to type 100,000 (100 K) pages (34,000 pages for each of the environments), thereby producing developers experiencing aging since an initial phase.

These developers were sampled and measured for a charge amount at low humidity, L-value, and a charge amount at high humidity, H-value, and an environmental charge performance A-value is derived from the following formula:

Environmental charge performance *A*-value=(charge amount at low humidity,*L*-value)/(charge amount at high humidity,*H*-value).

Note that the larger absolute value is to be used when there is a difference between an L-value (or H-value) of a developer at initial phase and an L-value (or H-value) of the developer after aging.

The followings were used as the small particle size silica.

SS-1: manufactured by EVONIK Industries AG; name: R976S; average first particle diameter: 7 nm.

SS-2: manufactured by EVONIK Industries AG; name: R974; average first particle diameter: 12 nm.

SS-3: manufactured by WACKER Chemie AG; name: H2000T; average first particle diameter: 12 nm.

The followings were used as the large particle size silica.

BS-1: manufactured by Shin-Etsu Chemical Co., Ltd.; name: X-24-9600A-80; average first particle diameter: 80 nm.

BS-2: manufactured by EVONIK Industries AG; name: SX-110; average first particle diameter: 110 nm.

BS-3: manufactured by Cabot Corporation; name: TG-C110; average first particle diameter: 110 nm.

The following was used as the fine powder.

FPS: manufactured by Sharp Corporation, name: FPS-D15 (indicated as "FPS" in Table 1), average first particle diameter: 15 nm (see Manufacturing Example 3).

The followings were used as titanium oxide.

TI-1: manufactured by EVONIK Industries AG; name: T805; average first particle diameter: 21 nm.

TI-2: manufactured by TAYCA Corporation, name: JMT-150FI; average first particle diameter: 15 nm.

The following was used as aluminum oxide.

Al-1: manufactured by EVONIK Industries AG; name: C805; average first particle diameter: 13 nm.

Manufacturing Example 1

A toner master particle A used in the examples and comparative examples was prepared as follows:

Binder resin: amorphous polyester resin A (Manufacturing Example 1) 68% by mass;

crystalline polyester resin (crystalline polyester resin C1, Manufacturing Example 2) 20% by mass;

Colorant: carbon black (manufactured by Mitsubishi Chemical Corporation, MA-100) 7% by mass;

Mold lubricant: monoester-based wax (manufactured by NOF Corporation, product name: WEP-3) 5% by mass;

Charge regulator: salicylic acid-based compound (Orient Chemical Industries Co., Ltd., product name: Bontron E-84) 1% by mass.

The materials described above were pre-mixed for 5 minutes with an airflow mixer (a Henschel mixer, manufactured by Mitsui Mining Co., Ltd. (present Nippon Coke & Engineering Co., Ltd.); model: FM20C), and then melt-kneaded with an open roll continuous kneader (manufactured by Mitsui Mining Co., Ltd. (present Nippon Coke & Engineering Co., Ltd.); model: MOS320-1800) to produce a melt-kneaded material.

The setting conditions of the open rolling were a supply part temperature of 130° C. and an emission part temperature of 100° C. in a heating roller, and a supply part temperature of 40° C. and an emission part temperature of 25° C. in a cooling roller. As the heating roller and the cooling roller, rollers having a diameter of 320 mm and an effective length of 1550 mm were employed, and both inter-roller gaps on the supply part and the emission part were set to 0.3 mm. The setting also had a rotation speed of the heating roller of 75 rpm, a rotation speed of the cooling roller of 65 rpm, and a supply of the toner raw material of 5.0 kg/h.

The melt-kneaded material thus obtained was cooled on a cooling belt, and then roughly milled with a speed mill having a screen with φ2 mm to produce a roughly-milled product.

The roughly-milled product thus obtained was finely milled with a jet mill (manufactured by Nippon Pneumatic Mfg. Co., Ltd.; model: IDS-2) to produce a finely-milled product (finely-milling step).

Then, the finely-milled product thus obtained was classified with an elbow jet classifier (Nittetsu Mining Co., Ltd.; model: EJ-LABO) to produce the toner master particle A (classifying step).

The electrostatic capacity value a of the toner master particle A thus obtained was 0.995.

Manufacturing Example 2

A toner master particle B used in the examples and comparative example was prepared as follows:

Binder resin: amorphous polyester resin A (Manufacturing Example 1) 68% by mass;

crystalline polyester resin (crystalline polyester resin C1, Manufacturing Example 2) 20% by mass;

Colorant: C.I. Pigment Blue 15:3 (manufactured by DIC Corporation) 7% by mass;

Mold lubricant: monoester-based wax (manufactured by NOF Corporation, product name: WEP-3) 5% by mass;

Charge regulator: salicylic acid-based compound (Orient Chemical Industries Co., Ltd., product name: Bontron E-84) 1% by mass.

The materials described above were pre-mixed for 5 minutes with an airflow mixer (a Henschel mixer, manufactured by Mitsui Mining Co., Ltd. (present Nippon Coke & Engineering Co., Ltd.); model: FM20C), and then melt-kneaded with an open roll continuous kneader (manufactured by Mitsui Mining Co., Ltd. (present Nippon Coke & Engineering Co., Ltd.); model: MOS320-1800) to produce a melt-kneaded material.

The setting conditions of the open rolling were a supply part temperature of 130° C. and an emission part temperature of 100° C. in a heating roller, and a supply part temperature of 40° C. and an emission part temperature of 25° C. in a cooling roller. As the heating roller and the cooling roller, rollers having a diameter of 320 mm and an effective length of 1550 mm were employed, and both inter-roller gaps on the supply part and the emission part were set to 0.3 mm. The setting also had a rotation speed of the heating roller of 75 rpm, a rotation speed of the cooling roller of 65 rpm, and a supply of the toner raw material of 5.0 kg/h.

The melt-kneaded material thus obtained was cooled on a cooling belt, and then roughly milled with a speed mill having a screen with φ2 mm to produce a roughly-milled product.

The roughly-milled product thus obtained was finely milled with a jet mill (manufactured by Nippon Pneumatic Mfg. Co., Ltd.; model: IDS-2) to produce a finely-milled product (finely-milling step).

Then, the finely-milled product thus obtained was classified with an elbow jet classifier (Nittetsu Mining Co., Ltd.; model: EJ-LABO) to produce the toner master particle B (classifying step).

The electrostatic capacity value a of the toner master particle B thus obtained was 1.031.

Manufacturing Example 3

A fine powder used in examples, FPS-D15, was prepared as follows.

A silica dispersion was made by mixing 500 mL of ion-exchanged water and 50 g of hydrophilic fumed silica (manufactured by Nippon Aerosil Co., Ltd.; product name: AEROSIL 130). The dispersion thus obtained was heated to 45° C., and 100 mL of sodium aluminate solution with an Al(OH)3 concentration of 50 g/L and 5N sodium hydroxide aqueous solution were dropped so as to provide a pH of 6.0. A 0.5N dilute hydrochloric acid was added so as to provide the dispersion with a pH of 3-4. Then, 25 g of γ-aminopropyltriethoxysilane was added to the dispersion. A 2N sodium hydroxide aqueous solution was added so as to provide the dispersion with a pH of 6.5. The dispersion thus obtained was filtered to produce a wet cake. The wet cake thus obtained was washed with water, and then dried to produce a dried material 1.

The dried material 1 thus obtained was milled with a collision plate jet mill (manufactured by Nippon Pneumatic Mfg. Co., Ltd.; model: IJT-2) under a condition with a milling pressure of 0.6 MPa to produce a milled material.

To a surface treatment solution obtained by introducing and mixing 500 mL of n-hexane and 0.2 g of amino degenerated silicone oil, 50 g of the milled material was added and stirred to produce a mixture solution. The mixture solution thus obtained was warmed to 70° C. and stirred, and dried with a vacuum drier until the contents no longer decreasing in mass, to produce a dried material 2.

The dried material 2 thus obtained was heated at 200° C. in an electric furnace for 3 hours and cooled to produce aggregate of a composition of silica and aluminum hydroxide.

The aggregate was milled with the collision plate jet mill described above under a condition of a milling pressure of 0.6 MPa to produce a fine powder, FPS-D15.

Example 1

External Addition Treatment

To an FM mixer (manufactured by Nippon Coke & Engineering Co., Ltd.; model: FM-20), 100 parts by mass of the toner master particle A thus obtained, 1.2 parts by mass of a small particle size silica (manufactured by EVONIK Industries AG; name: R974; average first particle diameter: 12 nm), and 1.0 parts by mass of a large particle size silica (manufactured by EVONIK Industries AG; name: SX-110; average first particle diameter: 110 nm) were introduced and mixed for a minute with a circumferential speed set to 40 m/sec on the outermost periphery of the tip of a stirring blade (first external addition).

Then, 0.7 parts by mass of a fine powder (manufactured by Sharp Corporation; name: FPS-D15; average first particle diameter: 15 nm) was introduced into the FM mixer, and mixed for 1.5 minutes with a circumferential speed set to 40 m/sec on the outermost periphery of the tip of the stirring blade (second external addition). The mixture thus obtained was sieved with a 270-mesh sieve to produce an externally-added toner.

Preparation of Developer

The externally-added toner thus obtained and a coating carrier (manufactured by Sharp Corporation; name: genuine carrier for MX-5111FN) were introduced into a V-shaped mixer (manufactured by Tokuju Corporation; product name: V-5) so as to provide a toner concentration of 7% by mass, and mixed for 20 minutes to produce a two-component developer.

Examples 2-15

An externally-added toner and a two-component developer were obtained in the same manner as in Example 1 except for using the toner master particle and the external additives shown in Table 1.

Comparative Example 1

An externally-added toner and a two-component developer were obtained using the toner master particle A, in the same manner as in Example 1 except for using titanium oxide (TI-1) instead of a fine powder.

Comparative Example 2

An externally-added toner and a two-component developer were obtained using the toner master particle A, in the same manner as in Example 1 except for not using a fine powder.

Comparative Example 3

An externally-added toner and a two-component developer were obtained using the toner master particle B, in the same manner as in Example 1 except for using titanium oxide (TI-2) instead of a fine powder.

Comparative Example 4

An externally-added toner and a two-component developer were obtained using the toner master particle B, in the same manner as in Example 1 except for not using a fine powder.

Comparative Example 5

An externally-added toner and a two-component developer were obtained using the toner master particle B, in the same manner as in Example 1 except for using aluminum oxide (Al-1) instead of a fine powder.

Given that the coating ratio of a small particle size silica is defined as 1 for two types of the toner master particles having electrostatic capacity values a of 0.995 and 1.031, externally-added materials with a coating ratio of a fine powder, X or P, and a coating ratio of a large particle size silica, Y or Q, refer to Examples 1-15.

As for the comparative examples, materials employing titanium oxide instead of a fine powder refer to Comparative Examples 1 and 3; materials without titanium oxide and a fine powder refer to Comparative Examples 2 and 4; and a material employing aluminum oxide instead of a fine powder refers to Comparative Example 5.

The measurement results of environmental charge performance of the developers was subjected to general evaluation (judgement) in accordance with the following criteria.

+++: Excellent (environmental charge performance A-value <1.5)

++: Good (environmental charge performance A-value <2.0)

+: Practical level (environmental charge performance A-value <2.4)

−: Poor (environmental charge performance A-value ≥2.4)

Table 1 shows ingredients and their physical properties of the toners, and physical properties and evaluation results of the two-component developers.

TABLE 1

| | Material | | | | | | | | | developer | |
|---|---|---|---|---|---|---|---|---|---|---|---|
| | Toner master particle | External additive | | | | | | | | Environmental | |
| | Electrostatic capacity | Small particle | Fine | Large particle | Coating ratio | | | | Dispersion value | charge performance A | Overall |
| | value a | size silica | powder | size silica | X | Y | P | Q | f | value | rating |
| Example 1 | 0.995 | SS-2 | FPS | BS-2 | — | — | 0.29 | 0.08 | 0.946 | 1.3 | +++ |
| Example 2 | 0.995 | SS-2 | FPS | BS-2 | — | — | 0.29 | 0.26 | 0.943 | 1.3 | +++ |
| Example 3 | 0.995 | SS-2 | FPS | BS-2 | 0.47 | 0.13 | — | — | 0.945 | 1.3 | +++ |
| Example 4 | 0.995 | SS-2 | FPS | BS-2 | — | — | 0.29 | 0.01 | 0.944 | 1.5 | ++ |
| Exemple 5 | 0.995 | SS-2 | FPS | BS-2 | — | — | 0.29 | 0.30 | 0.944 | 1.5 | ++ |
| Example 6 | 0.995 | SS-2 | FPS | BS-2 | — | — | 0.29 | 0.26 | 0.902 | 2.0 | + |
| Example 7 | 0.995 | SS-2 | FPS | BS-2 | — | — | 0.20 | 0.26 | 0.945 | 1.5 | ++ |
| Example 8 | 0.995 | SS-2 | FPS | BS-2 | — | — | 0.12 | 0.26 | 0.940 | 2.1 | + |
| Example 9 | 1.031 | SS-2 | FPS | BS-2 | 0.47 | 0.04 | — | — | 0.944 | 1.2 | +++ |
| Example 10 | 1.031 | SS-2 | FPS | BS-2 | 0.47 | 0.26 | — | — | 0.940 | 1.2 | +++ |
| Example 11 | 1.031 | SS-2 | FPS | BS-2 | 0.47 | 0.01 | — | — | 0.944 | 1.6 | ++ |
| Example 12 | 1.031 | SS-2 | FPS | BS-2 | 0.47 | 0.30 | — | — | 0.943 | 1.7 | ++ |
| Example 13 | 1.031 | SS-2 | FPS | BS-2 | 0.47 | 0.26 | — | — | 0.912 | 2.2 | + |
| Example 14 | 1.031 | SS-2 | FPS | BS-2 | 0.40 | 0.26 | — | — | 0.955 | 1.8 | ++ |
| Example 15 | 1.031 | SS-2 | FPS | BS-2 | 0.37 | 0.26 | — | — | 0.950 | 2.3 | + |
| Comparative Example 1 | 0.995 | SS-2 | TI-1 | BS-2 | — | — | — | — | — | 2.4 | − |
| Comparative Example 2 | 0.995 | SS-2 | — | BS-2 | — | — | — | — | — | 2.5 | − |
| Comparative Example 3 | 1.031 | SS-2 | TI-1 | BS-2 | — | — | — | — | — | 2.4 | − |
| Comparative Example 4 | 1.031 | SS-2 | — | BS-2 | — | — | — | — | — | 2.6 | − |
| Comparative Example 5 | 1.031 | SS-2 | Al-1 | BS-2 | — | — | — | — | — | 2.7 | − |

Table 2 describes detailed data of the developers in Comparative Example 1, Comparative Example 2, and Example 9 excerpted from Table 1.

TABLE 2

| | | Comparative Example 1 | Comparative Example 2 | Example 9 |
|---|---|---|---|---|
| | External additive | Titanium oxide | Without titanium oxide | Fine powder |
| Initial | Charge amount H value under high humidity environment (μC/g) | −30 | −10 | −15 |
| | Charge amount L value under low humidity environment (μC/g) | −36 | −25 | −21 |
| | Environmental charge performance L value/H value | 1.2 | 2.5 | 1.4 |
| After printing 100K pages | Charge amount H valbe under high humidity environment (μC/g) | −15 | −10 | −17 |
| | Charge amount L value under low humidity environment (μC/g) | −20 | −50 | −35 |
| | Environmental charge performance L value/H value | 1.3 | 5.0 | 2.1 |
| Environmental charge performance value A through life | | 2.4 | 2.5 | 1.2 |

The toner externally added with titanium oxide (Comparative Example 1) and the toner externally added with neither titanium oxide nor a fine powder (Comparative Example 2) have initial environmental charge performance A-values (initial Deve), 1.2 and 2.5, respectively, indicating that the former toner has a higher environmental charge performance because an ideal value is 1.

In addition, the environmental charge performance A-values, after typing of 100 K pages (Deve after typing of 100 K pages) are 1.3 and 5.0, respectively, and the toner externally added with titanium oxide appears to maintain a high environmental charge performance. However, the environmental charge performance values throughout life since an initial phase until after typing of 100 K pages are 2.4 and 2.5, respectively.

By contrast, the toner externally added with a fine powder (Example 9) has an initial Deve of 1.4 and a Deve of 2.1 after typing of 100 K pages, but has an environmental charge performance value of 1.2 throughout life since an initial phase until after typing of 100 K pages, indicating high performance. Such improvement in environmental charge performance throughout whole Deve Life can create optimal developing conditions for a long term, and improve quality of images.

Figure 1B:
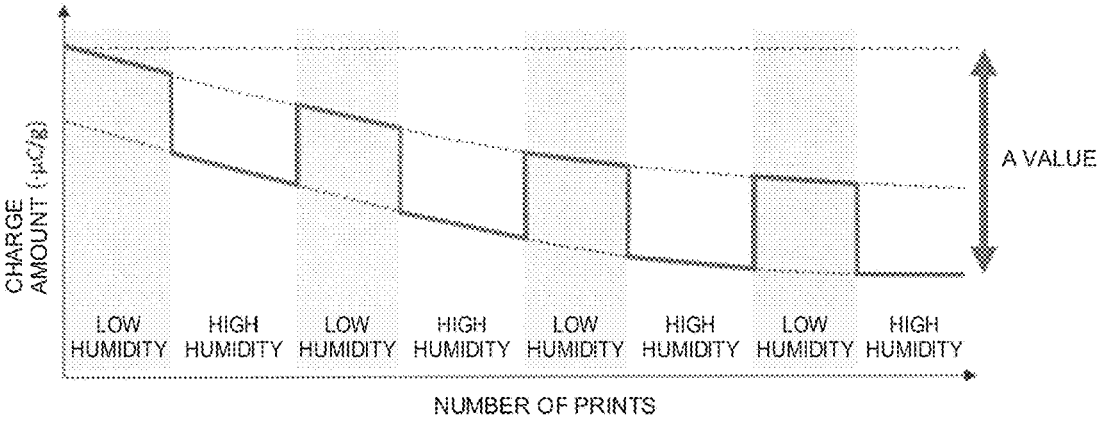
Figure 1C:
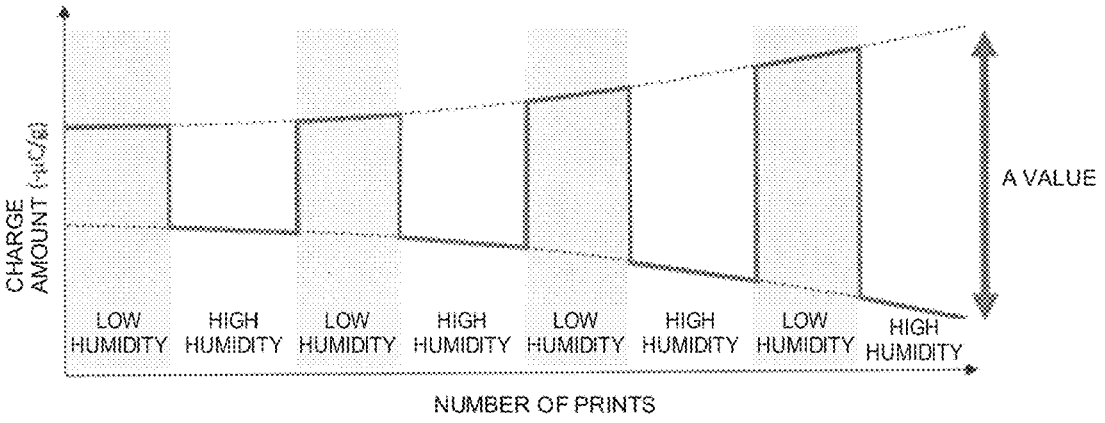

FIGS. 1A, 1B, and 1C show relation between the number of typed pages of the toner and charge amount.

Because representing to a negatively-charged toner, FIG. 1 shows the vertical axis unit of the graphs as "−uQ/g", which indicates expression for magnitude of charge amount as expression with absolute values.

Generally, a toner has aging of a developer with increasing number of prints, and changes in its charge performance.

FIG. 1A shows a change of charge amount of the toner externally added with a fine powder (Example 9), and indicates having an action slightly smaller than that of titanium oxide in the toner externally added with titanium oxide in FIG. 1B (Comparative Example 1) but having a small change with increasing number of prints.

FIG. 1B shows a change of charge amount of the toner externally added with titanium oxide (Comparative Example 1), and indicates that titanium oxide acts to reduce environmental charge performance A-value, which is difference of charge amounts at high humidity and low humidity, while whole charge amount reduces with increasing number of prints.

FIG. 1C shows a change of charge amount of the toner externally added with neither titanium oxide nor a fine powder (Comparative Example 2), and indicates that due to reduced charge amount at high humidity and increased charge amount at low humidity, environmental charge performance A-value, which is their difference, becomes larger.

Figure 2:
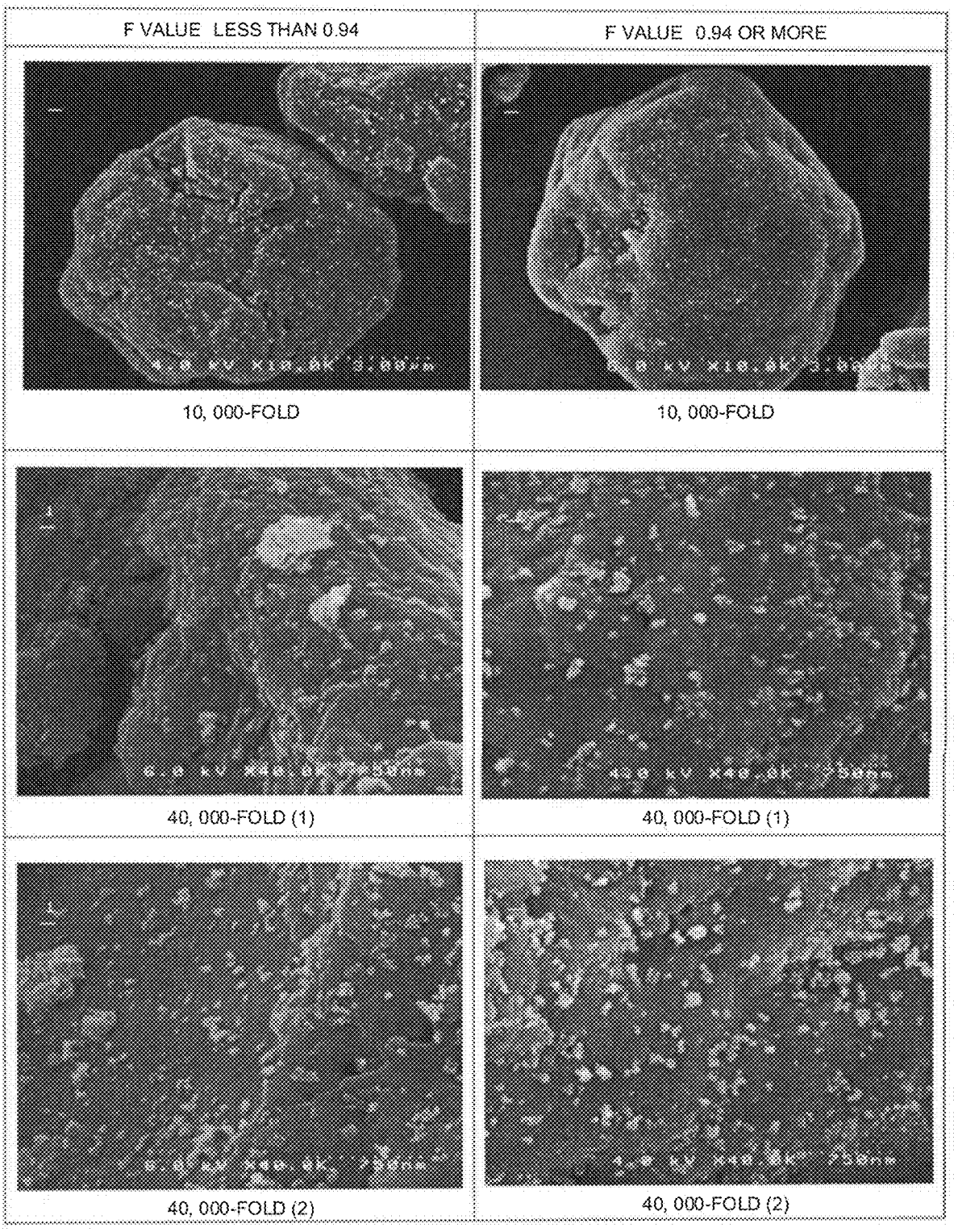
FIG. 2 represents SEM images showing dispersion conditions of a fine powder corresponding to dispersion values f of the fine powder in a toner on a toner master particle.

FIG. 2 represents SEM images (10,000-fold and 40,000-fold) showing dispersion conditions of a fine powder corresponding to dispersion value f of the fine powder in a toner on a toner master particle.

When a non-externally-added toner particle is externally added only with the fine powder, dispersion level changes in accordance with stirring force or time at external addition, as in SEM images in FIG. 2.

The extent of the dispersion depends on resistance value of the externally-added toner, and f-value, which is calculated from a ratio of resistance values of before and after external addition of the fine powder, is to be an indicator thereof. The amount of the fine powder at measurement of f-value is a specified amount in the present invention, and the measuring method thereof is as described above.

With a f-value of less than 0.94, dispersion of the external additive (fine powder) is insufficient, and aggregation of the fine powder is observed, as in the left column in FIG. 2.

External addition in combination of silica and a fine powder can also employ stirring force and time with the same conditions as those at measurement of a f-value.

Figure 3A:
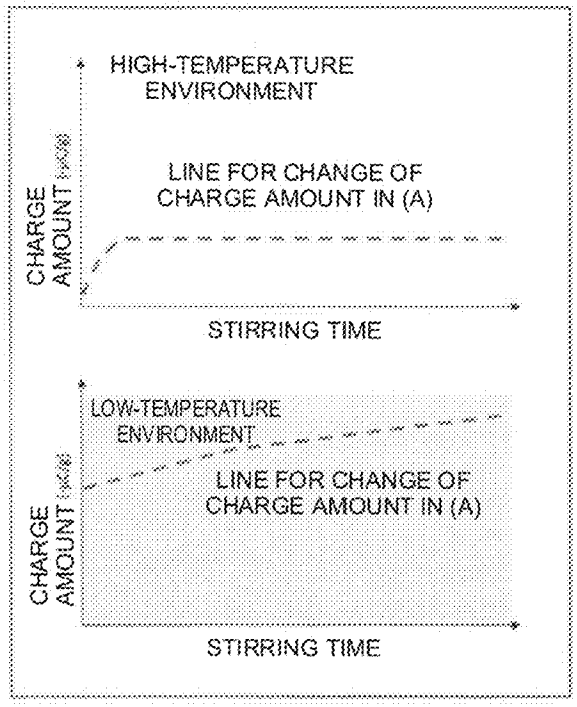
FIGS. 3A, 3B, and 3C show relations between stirring time and charge amount of a developer in a developing chamber.
Figure 3B:
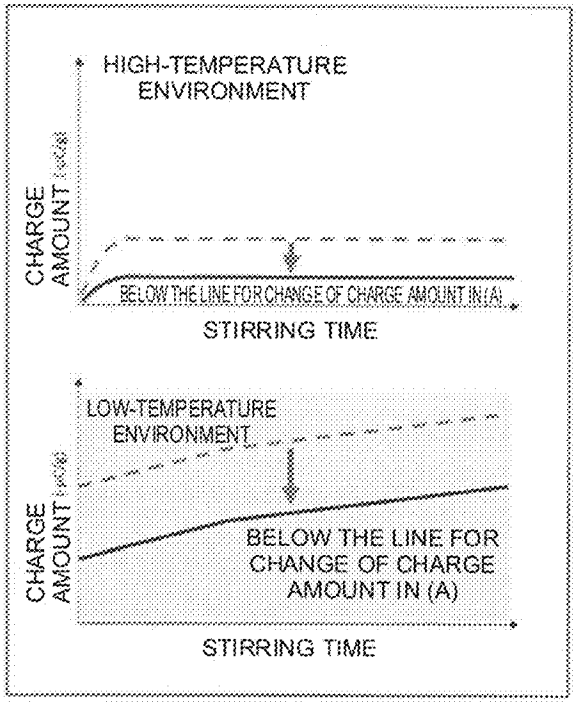
Figure 3C:
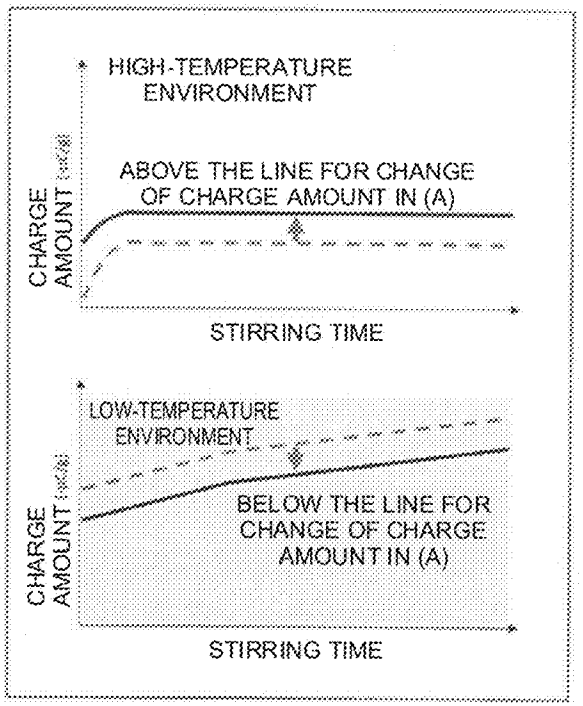

FIGS. 3A, 3B, and 3C represents a figure showing relations between stirring time and charge amount of a developer in a developing chamber, i.e., a graph showing dependence between charge amount of the developer and stirring time in the developing chamber.

FIG. 3A shows a change of charge amount of the toner externally added with neither titanium oxide nor a fine powder (Comparative Example 2). With use of a material having a characteristic of providing a smaller environmental charge performance A-value (Examples 1-15 and Comparative Example 1, Comparative Example 3), charge amount at high humidity increases more than that of FIG. 3A, and charge amount at low humidity decreases less than that of FIG. 3A, as shown in FIG. 3C.

The toner externally added with hydrophobized aluminum oxide instead of a fine powder (Comparative Example 5) has less charge amount both at high humidity and low humidity as shown in FIG. 3B. The environmental charge performance A-value may be smaller than that of FIG. 3A depending on an extent of the reduction, but decrease in charge amount at high humidity below that of FIG. 3A leads to striking decrease in developing performance, thus preventing use for a developer.

The results suggest that decrease in dispersion value, f-value, of a fine powder has a great influence on increase in environmental charge performance A-value, and therefore that, in use of a fine powder, improvement in dispersion of a fine powder within the range of a ratio of coating rates leads to improvement in environmental charge performance of a developer throughout life.

What is claimed is:

1. A toner comprising at least a negatively-charged toner master particle, and an external additive externally added onto a surface of the toner master particle, wherein the external additive comprises a fine powder and a small particle size silica having an average particle diameter smaller than that of the fine powder, and wherein the fine powder is a composition comprising at least aluminum hydroxide and silica and has a surface treated with silane, wherein the toner master particle is further externally added with a large particle size silica having an average particle diameter larger than that of the fine powder, wherein when an electrostatic capacity value of the toner master particle is less than 1, a coating ratio of the small particle size silica, the fine powder (P), and the large particle size silica (Q) on the toner master particle, 1:P:Q, satisfies relations of the following formulae:

$$P \geq 0.20 \text{ and } 0.27 \geq Q \geq 0.04; \text{ and}$$

wherein when the electrostatic capacity value of the toner master particle is 1 or more, a coating ratio of the small particle size silica, the fine powder (X), and the large particle size silica (Y) on the toner master particle, 1:X:Y, satisfies relations of the following formulae:

$$X \geq 0.46 \text{ and } 0.27 \geq Y \geq 0.04.$$

2. The toner according to claim 1, wherein the fine powder has a dispersion value of 0.94 or more on the toner master particle.

3. The toner according to claim 1, wherein the fine powder has an average particle diameter of 10 to 40 nm.

4. A developer comprising the toner according to claim 1, and a carrier.

* * * * *